United States Patent [19]

Zimmerman

[11] 4,443,901

[45] Apr. 24, 1984

[54] CONVERTIBLE SEATING FURNITURE

[75] Inventor: Jon P. Zimmerman, Spring City, Tenn.

[73] Assignee: The Sherwood Corporation, Spring City, Tenn.

[21] Appl. No.: 367,368

[22] Filed: Apr. 12, 1982

[51] Int. Cl.[3] ..... A47C 17/00

[52] U.S. Cl. ..... 5/28; 5/12 R; 5/465

[58] Field of Search ..... 5/12 R, 28, 43, 44 R, 5/465; 297/118

[56] References Cited

U.S. PATENT DOCUMENTS

| | | | |
|---|---|---|---|
| 3,829,913 | 8/1974 | Bernard | 5/12 R |
| 4,173,045 | 11/1979 | Osborn | 5/12 R |

FOREIGN PATENT DOCUMENTS

| | | | |
|---|---|---|---|
| 2511463 | 1/1976 | Fed. Rep. of Germany | 5/12 R |
| 2656715 | 3/1977 | Fed. Rep. of Germany | 5/12 R |
| 2853941 | 7/1979 | Fed. Rep. of Germany | 5/12 R |
| 2907105 | 12/1979 | Fed. Rep. of Germany | 5/12 R |
| 2936681 | 3/1981 | Fed. Rep. of Germany | 5/43 |
| 586532 | 3/1975 | Switzerland | 5/12 R |

*Primary Examiner*—Alexander Grosz
*Assistant Examiner*—Michael F. Trettel
*Attorney, Agent, or Firm*—Alan Ruderman

[57] ABSTRACT

A unit of furniture readily convertible from a settee to a sleeper has a base member on which a seating member is normally disposed in overlying disposition and hingedly attached thereto by upholstery covering along a common edge thereof. The seating member has a pair of arm supports hingedly connected to the base member along the same edge. At least one back support is hingedly connected to the seating surface of the seating member for pivoting from a substantially upright disposition onto the seating surface. A bolster member is hingedly connected on the top of a rear cross member for pivoting into the space left vacant by the back support members when the latter have been pivoted onto the seating surface. When the back support members and bolster members are so pivoted into side-by-side disposition with the base member for use as a sleeper.

5 Claims, 8 Drawing Figures

CONVERTIBLE SEATING FURNITURE

BACKGROUND OF THE INVENTION

This invention relates to furniture that readily converts from a seating unit to a sleeping unit, and more particularly to convertible furniture of this type including an occupant receiving upper portion hinged to a base portion for pivoting from a seating unit to a sleeping unit, the occupant receiving portion comprising a seating surface, arms and back support members which remain together as the upper portion is pivoted.

Heretofore, various constructions of seating/sleeping convertible furniture units have been proposed. Some of these have been of the heavy complicated mechanically articulated type; while others are of the fold-open type. The present invention is directed toward convertible furniture of the latter type.

One such construction of fold-open convertible furniture is illustrated in U.S. Pat. No. 3,740,774 wherein a pair of rectangular foam blocks are separately covered with upholstery which hingedly connects the blocks together while permitting the blocks to be positioned in either an overlying relationship with one on the other, or in a side-by-side relationship with both blocks on the floor. With this construction bolsters or pillows merely rest upon and are separate from the upper block to form arms and back rests when the unit is a seating unit. Thus, when used as a sofa or the like, the unit must be placed against a wall or the back bolsters will fall over and off the unit when an occupant leans against the back. Furthermore, since the arms are loose they also have a tendency to be dislodged from the seating surface.

With other proposed constructions, the limitations imposed by the arms and back have resulted in comfort and/or geometrical design limitations, thereby limiting their appeal and acceptance in the market place.

SUMMARY OF THE INVENTION

It is a primary object of the present invention to provide a fold-open unit of furniture readily convertible from a seating unit to a sleeping unit.

It is another object of the present invention to provide a fold-open convertible furniture unit including a seating portion hingedly connected to a base portion, the seating portion including back and arm supports attached to the occupant receiving surface and movable therewith from a seating disposition on the base to a side-by-side disposition with the base.

It is a further object of the present invention to provide a fold-open convertible furniture unit including a seating portion hingedly connected to and normally disposed upon a base portion at an edge thereof, the seating portion including back and arm supports, the top of the back support being above the arm supports and being pivotable onto the seating surface of the seating portion so that the seating portion can be pivoted from the seating disposition on the base to a side-by-side disposition with the base.

Consequently, one aspect of the present invention provides a convertible unit of furniture readily convertible from a settee such as a sofa or love-seat to a large sleeper, the unit comprising a base member on which a seating member is normally disposed in overlying disposition and hingedly attached thereto by upholstery covering along an edge thereof so that the seating member may be pivoted into juxtaposed side-by-side disposition with the base member, the seating member having a pair of arm supports hingedly connected to the base member along the same edge, and at least one back support member hingedly connected for pivoting from a substantially upright disposition to a reclined disposition onto the seating surface of the seating member for aiding and supporting the seating member after it has pivoted to the sleeper condition.

In the preferred form of the invention the back support normally rests against a rear support and the depth of the seating surface from the leading edge to the back support is such as to provide a conventional comfort zone for sitting with the arm supports at the proper elevation for comfort. To provide the correct comfort zone and arm height, and yet have the thickness of the back support substantially the same dimension as the top of the arm support, another aspect of the invention provides that a portion of the rear support is hingedly mounted for pivoting into the space left vacant by the back support after it has been pivoted. This not only provides a comfortable seating unit, but adds to the support of the seating portion when it has been pivoted to the sleeper position.

To ensure the proper height of the seating surface above the floor for an occupant to sit comfortably, the height of the base member and the vertical thickness of the seating surface may be selected, taking the desired arm support height above the seating surface into account, such that the height of the arm support from the hinged edge is substantially equal to the height of the base.

The construction is such that an attractive furniture unit may be designed having both the aesthetic appeal and comfort required for a quality seating unit, and yet be capable of conversion into a sleeping unit easily. The simplicity of the construction, moreover, provides the convertibility feature.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
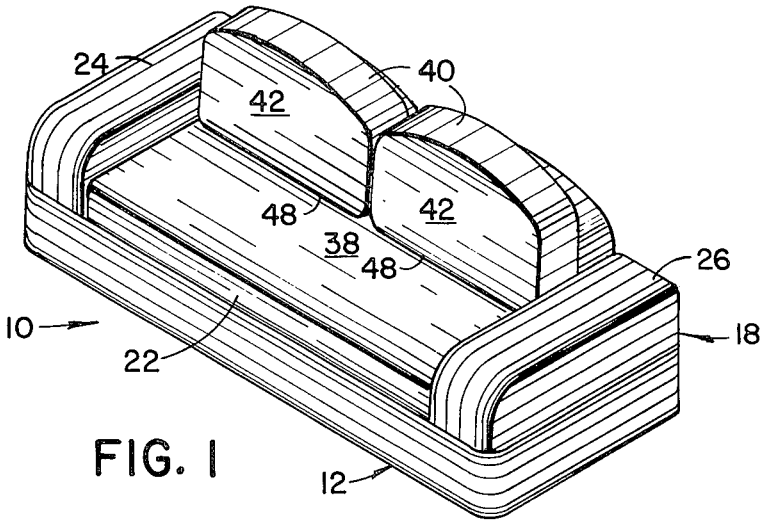
FIG. 1 is a front perspective view of a convertible settee furniture unit constructed in accordance with the principles of the present invention, the unit depicted being a sofa or love-seat and is illustrated in the seating condition.
Figure 2:
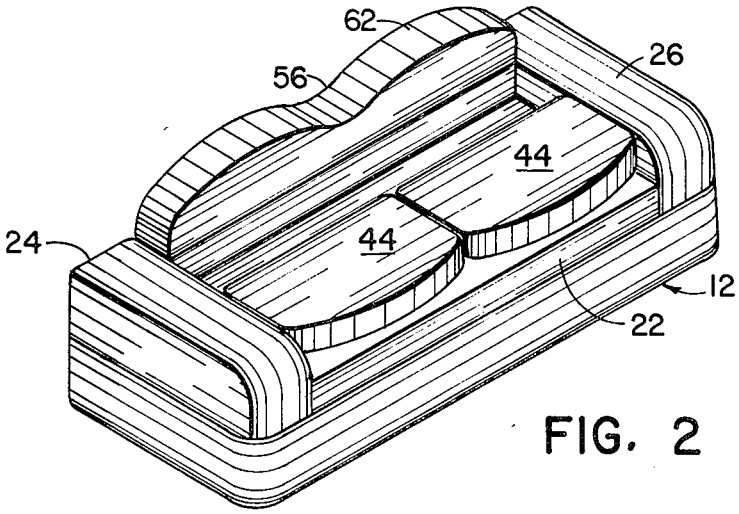
FIG. 2 is a perspective view of the settee with the back supports pivoted downwardly onto the seating surface as a first step preparatory to conversion to a sleeper unit.
Figure 3:
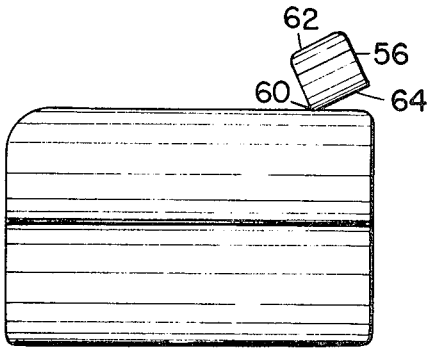
FIG. 3 is a side elevational view with the back support pivoted downwardly and with the bolster portion of the rear support in a partly pivoted position as it is being pivoted downwardly into the space vacated by the back supports.

Referring to the drawings, a convertible settee-bed generally illustrated at 10 is disclosed as a sofa or loveseat in the settee condition, but it is to be understood that the present invention is applicable to a settee of any size, such as a chair, and the bed size of the sleeper will of course vary accordingly. The settee comprises a base member 12 in the form of a substantially rectangular block of resilient plastic foam material 14 of a size conforming to the bed size desired and covered by an upholstered covering 16, preferably of a fabric material, at least about the vertical sides thereof, and an occupant receiving portion, generally indicated at 18, disposed on the upper surface 20 of the base member 12 and functioning as a seating unit.

The occupant receiving portion 18 includes a seat member 22 also of a substantially rectangular block of resilient foam bordered at its ends by a respective arm support members 24 and 26 and at its rear by a rear cross member 28. The arm support members and the rear cross member are also formed from plastic resilient foam material which may be glued or bonded together as a unit, and may likewise be bonded to the seat member 22. The planar shape and dimensions of the seat 22 together with the abutting arm members 24, 26 and the rear cross member 28 conforms substantially to the rectangular plan of the base member 12, and are covered by an upholstery covering 30 fabricated to the proper size and shape for receiving these members. The base portion covering 16 and the covering 30 along the corresponding front edge from the arm support 24 to the arm support 26 are sewn together to form and define a hinge 34, the seam preferably being reinforced by a fabric strip 36. The forming of the hinge 34 preferably occurs prior to the covering being applied to the foam material which is thereafter forced into the covering.

The height of the arm support members 22, 24 as measured from the upper surface 20 of the base member 12 is substantially equal to the height of the base member as measured from the floor to the upper surface 20. Since for most persons a comfortable seating unit generally has a seating surface 38 spaced about 16 inches from the floor, and arm rests that are approximately 6 inches above the level of the seating surface, an extremely comfortable unit is obtained with the construction of the present invention by providing the upper surface 20 of the base member 12 at an elevation of 11 inches above the floor. Thus, the thickness of the seat member 22 is 5 inches. It should be understood that these dimensions are those of the preferred embodiment and are not to be construed as limitations on the invention.

In the preferred form of the invention an occupant seating zone is provided on the surface 38 between the arms members 24 and 26 at the sides and at least one back support member 40 at the rear of the zone. In the preferred embodiment, for aesthetic purposes, it is preferred to have two such back support members each having an arcuate upper contour as illustrated. However, it is to be understood that any desired number of such supports may be utilized having unlimited geometrically shaped upper contours. The length of the number of back support 40, however, is substantially equal to the distance between the facing surfaces of the arm members 24 and 26. The depth from the normal front surface 42 of the support members 40 to the rear surface 44 thereof is substantially equal to the height of the arm members 24, 26 above the seat surface 38, which in the preferred embodiment is approximately 6 inches.

The back support members 40 comprise resilient foam material covered by upholstery 46, which is formed and sewn first at each front bottom edge 48 to the covering 30 of the seat, the seam preferably being reinforced by fabric strip 50 to form and define the hinge 52. For aesthetic purposes each back support 40 is separately covered to keep a clean line therebetween. Conventionally, a comfortable front to rear depth of the seating zone is approximately 21½ to 22 inches and the back support members when pivoted from the normal upright portion fill in most of the seating zone area if the height of the members 40 are sufficient. As illustrated, a small area is left vacant to preserve the more aesthetic appeal of the slightly shorter height back support members and yet preserve the comfortable depth of the seating zone.

Now, when it is desired to convert the settee to a sleeper the back support members are pivoted forwardly about hinge 52 so that the rear surfaces 44 are substantially equal to the top of the arm members 24, 26. Thereafter, the entire occupant receiving portion is pivoted forwardly about the hinge 34 so that the bottom surface 54 created by the bottom of the seat member 22, the arm members 24, 26 and the rear cross member 28, is substantially planar with the upper surface 20 of the base member 12. However, since there is a void, substantially equal to the thickness of the back support members, created between the back support members 40 and the rear cross member 28 when the back support members have been pivoted, another aspect of the present invention provides one or more bolster members 56 hingedly disposed on the rear cross member for pivoting into the space vacated by the back support members. The bolster preferably has a similar shape and form to the back members 40 for aesthetic purposes. A single bolster having a double hump configuration similar to that of the back support members is illustrated, although separate bolsters may be utilized. The bolster comprises foam material 57 covered by covering 58 sewn at the lower front edge 60 to fabric covering 61 on the upper front edge of the rear cross member 28 to form the hinge. The front to rear thichness of the bolster is substantially equal to that of the back support members 40, and the height of the bolster from the edge 60 is substantially equal to the height of the arms 24, 26 above the seat 38. Preferably the front to rear thickness of the bolster and the rear cross member are equal.

Figure 4:
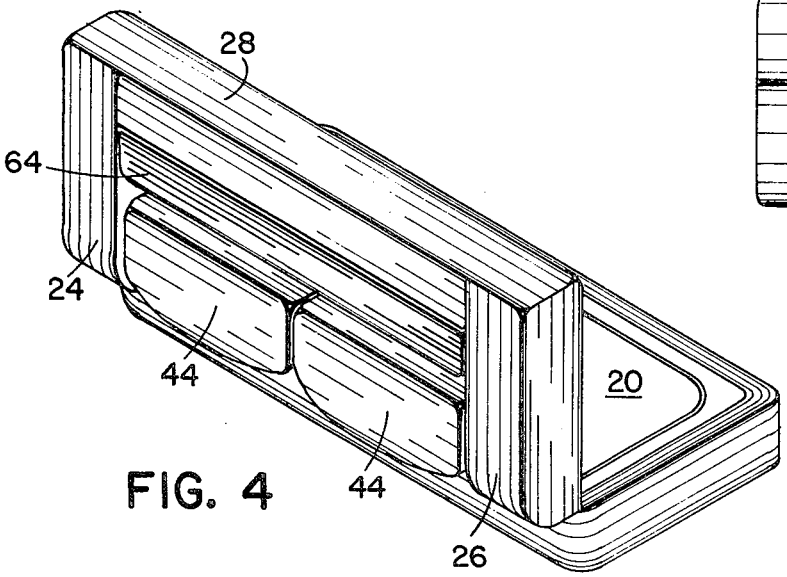
FIG. 4 is a perspective view illustrating the seating portion in an intermediate position as it is pivoted into the sleeper condition.

Thus, when the bolsters are pivoted 180° about the hinge at edge 60, their normal tops 62 engage the surface that the back supports have vacated and their normal bottoms 64 are substantially planar with the arm members and the rear surfaces of the back support members 40, as illustrated in FIG. 4. Since the members are resilient they quite satisfactorily fill in substantially all of the seating zone and compress to stay in place when the entire seating poriton 18 is pivoted about the hinge 34. Moreover, the resiliency allows the various members, such as the arm members 24, 26 to be of various surface configurations since after pivoting to the sleeping unit, the surfaces will flatten and conform to the floor.

Figure 5:
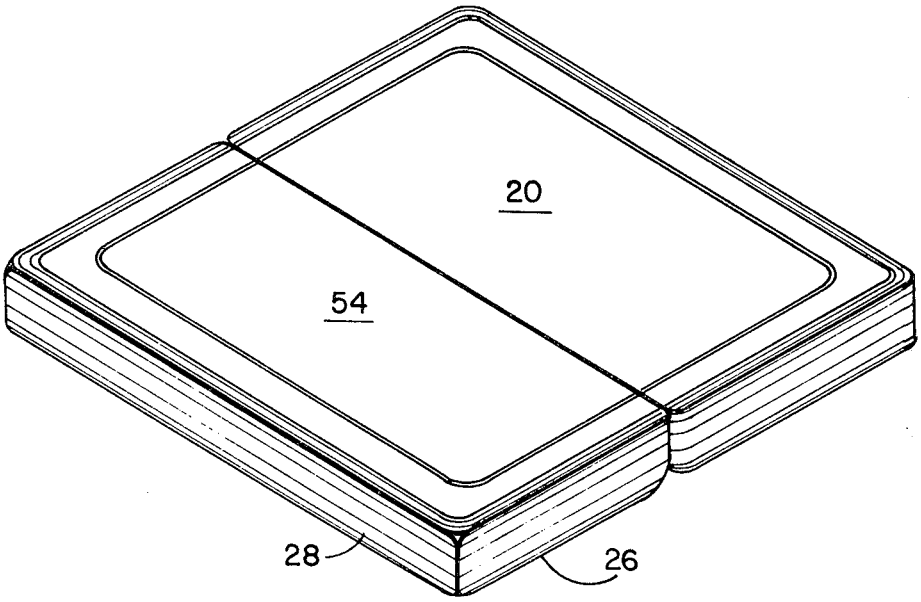
FIG. 5 is a perspective view of the unit fully converted to the sleeper condition.
Figure 6:
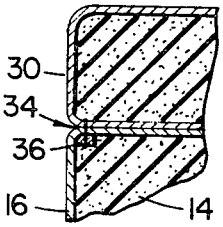
FIGS. 6, 7, and 8 are cross sectional views taken through the respective hinge of the base and seat, the seat and back, and the bolster and rear cross member.
Figure 7:
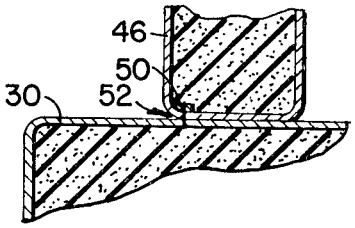
Figure 8:
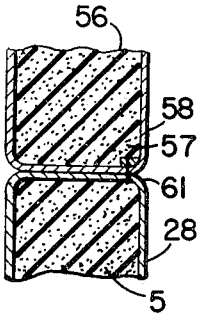

In the fully converted condition, as illustrated in FIG. 5, a full size double bed is provided, the size varying according to whether the settee is a sofa or a loveseat. For a single seat chair, the bed would open in the same manner but form a single or twin size bed.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. A convertible settee-bed comprising a substantially rectangular base in the form of a block for resting on a floor, and an occupant receiving portion normally positioned in overlying relation on the upper surface of the base for forming a settee, said occupant receiving portion including a seat member, an occupant receiving zone defined by a seating surface on the seat member bordered by a pair of spaced apart arm members and at least one back support member, a rear cross member spanning said arm members at the rear of the occupant receiving zone, each of said arm members and rear cross member having an upper surface spaced above the seating surface and at an elevation above the floor substantially equal to twice the elevation that the upper surface of said base is above the floor, said back support member having a thickness between a front and rear surface substantially equal to the difference in elevation between the seating surface and the upper surface of said arm members and rear cross member, a covering separately covering the base member and the occupant receiving portion and hingedly connecting the base member to the seat member and arm members along corresponding front edges, and a covering separately covering the back support member and hingedly connecting the back support member to the seating surface along corresponding edges of the occupant receiving zone, whereby said back support member may be pivoted from a normal substantially upright position with the rear surface abutting the rear cross member to a reclined position with the front surface abutting the seating surface, and the occupant receiving portion may be pivoted thereafter to a position in side-by-side relation with the base member for forming a bed.

2. A convertible settee-bed as recited in claim 1, wherein the top of said back support member in the normal upright position is spaced above the upper surface of the rear cross member and fills a substantial portion of said occupant receiving zone when pivoted to the reclined position.

3. A convertible settee-bed as recited in claim 1 or 2, including a bolster disposed on the upper surface of said rear cross member, said bolster having a thickness between a front and rear surface substantially equal to the thickness of said back support member, covering separately covering said bolster and hingedly connecting the bolster at a front edge the the front edge of the upper surface of the rear cross member, whereby said bolster may be pivoted into and substantially fill the space vacated by the back support member when the latter is in the reclined position.

4. A convertible settee-bed as recited in claim 1 or 2, wherein there are two back support members, each back support member being separately covered by covering and hingedly connected to said seating surface.

5. A convertible settee-bed as recited in claim 1, wherein said arm members and said rear cross member comprise resilient plastic foam.

* * * * *